US005145445A

United States Patent [19]

Northey

[11] Patent Number: 5,145,445

[45] Date of Patent: Sep. 8, 1992

[54] HEAD AND JAW ACTUATION DEVICE

[76] Inventor: William Northey, P.O. Box 38, Topsfield, Mass. 01983

[21] Appl. No.: 743,984

[22] Filed: Aug. 12, 1991

[51] Int. Cl.[5] ..... A63H 3/14

[52] U.S. Cl. ..... 446/329; 446/339

[58] Field of Search ..... 446/329, 327, 328, 337-341, 446/395

[56] References Cited

U.S. PATENT DOCUMENTS 2,633,670 4/1953 Steuber ..... 446/329

3,900,991 8/1975 Kosicki et al. ..... 446/338

FOREIGN PATENT DOCUMENTS 491169 12/1975 Australia ..... 446/329

2232899 1/1991 United Kingdom ..... 446/329

*Primary Examiner*—Mickey Yu

[57] ABSTRACT

This invention discloses a device for use in a puppet to effect theatrical motion of the mouth and head by pivoting up the top part of the head while simultaneously lowering the jaw. This method of actuating both parts of the head to simulate mouth movement also allows for rotation, tilting and exchange of the head in a glove type hand puppet.

15 Claims, 1 Drawing Sheet

Fig. 1
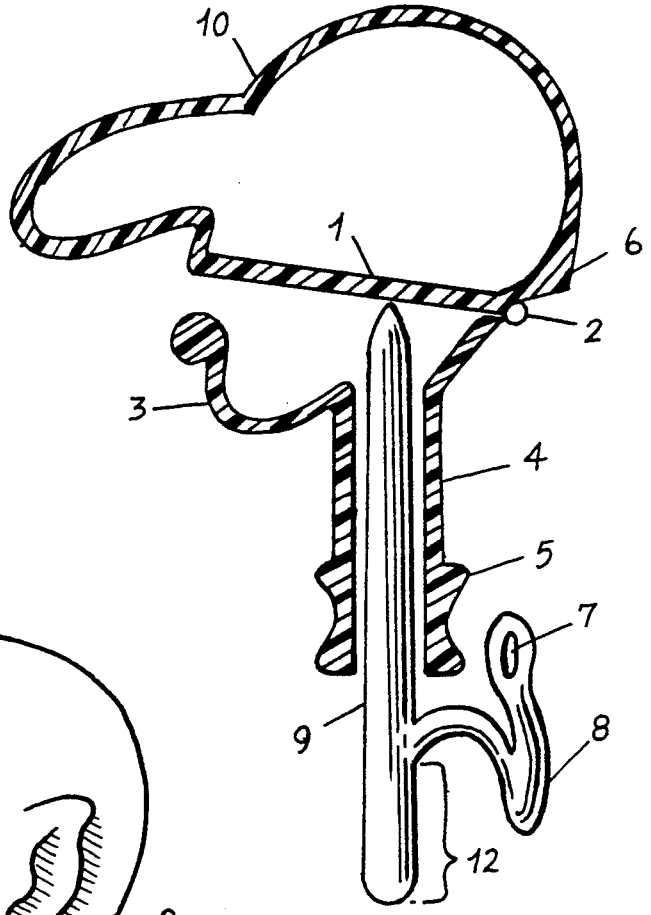
Fig. 2
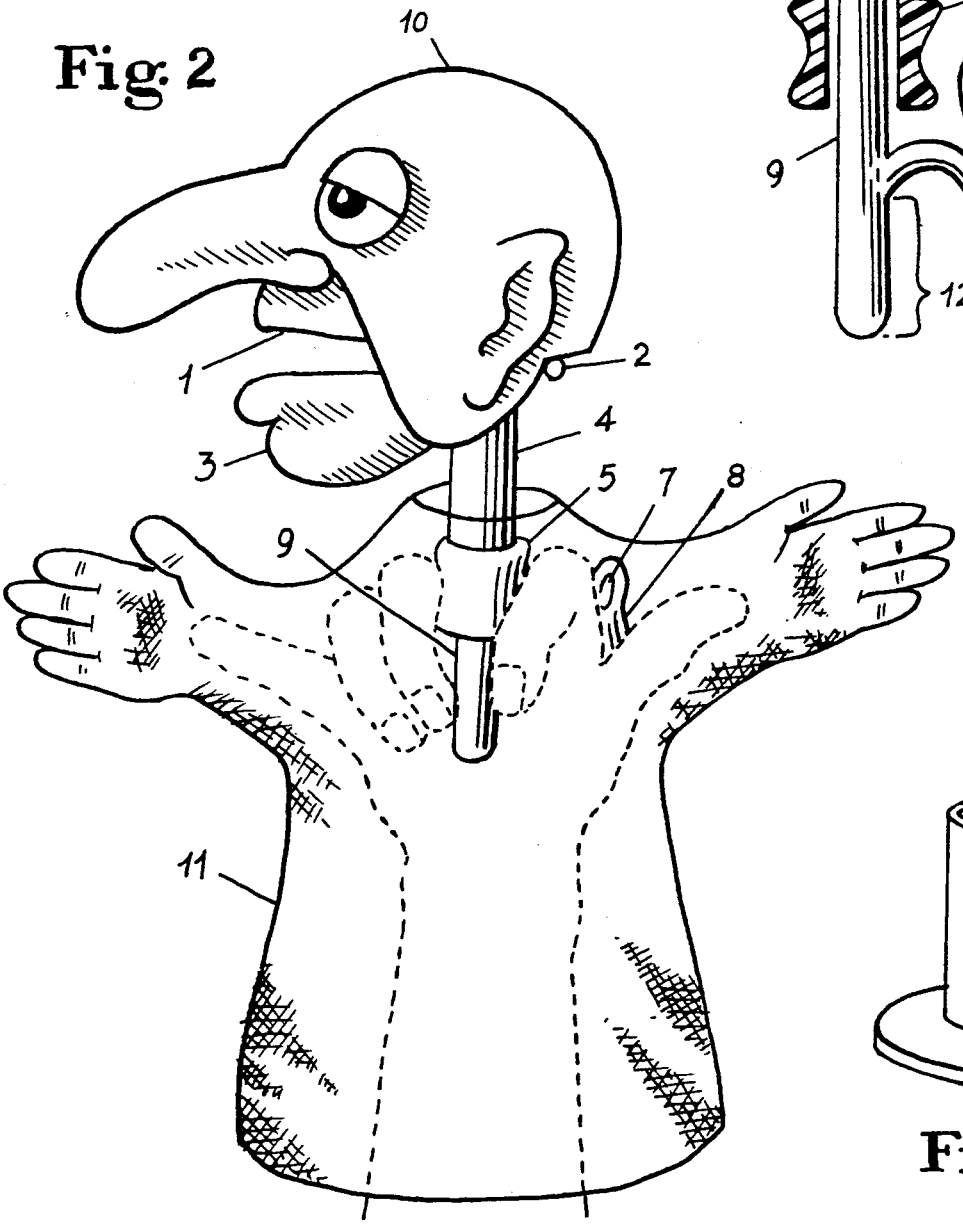
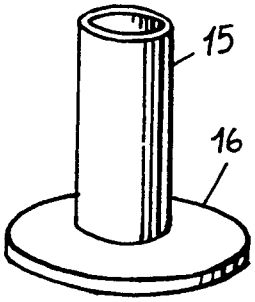
Fig. 3

HEAD AND JAW ACTUATION DEVICE

FIELD OF INVENTION

This invention refers to a hand puppet with acommodations in the body for inserting fingers into the arms of the puppet and operation of the head and jaw by other fingers of the same hand. This art is covered in U.S. Class 446.

SUMMARY OF THE INVENTION

The invention provides improved mouth actuation in a one hand operated puppet and allows full rotation of the head by means of a central stick which tilts up the upper part of the head by pressing on the rear of a mouthplate within the head which is hinged to the jaw of the puppet. A cylindrical neck tube slidably receives but is not attached to this central stick or the body of the puppet. the tube can be rotated to turn the entire head or pulled down to operate and control the jaw. The improved action simulating mouth movement and the ability to provide a comic spinning head and elongating neck action enhances the motion of the puppet and allows effects not presently possible with hand puppets, which may also be marots that have a stick support of the head. The invention enables greater artistic expression for the solo performer since it allows for single hand operation of the mouth, head and arms of the puppet.

OBJECTS OF THE INVENTION

One object of the invention is to increase the range of motion available to the puppet when operated with one hand.

Another object is to provide a puppet with simple means for exchanging heads.

Another object is to provide a toy easily assembled in kit form.

Another object is to provide an active figure which can be produced at low cost.

BACKGROUND AND PRIOR ART

The puppet field is divided into a number of areas. String operated marionettes are operated from above and have strings attached to each movable part to operate or move the part. Marionettes are hard to store, can becomes easily tangled, and are often difficult to operate.

Another grouping of puppets in the sock type and puppet. This entertainment vehicle is clearly different than the marionette type puppet. Sometimes called a mouth puppet, it is endowed with lips that can contort as fingers within the mouth are moved in various ways. The sock puppet can be very expressive, but if the sock puppet has no arms, it is a poor substitute in dramatic scenes where arm action as well as a mouth action is needed. A sock or mouth puppet usually requires two hand operation if both the mouth and arms of the puppet are to be actuated. Sock puppet upper head and mouth mobility are needed in puppets that also have movable arms and allow single hand operation.

There is another group of hand puppets in which the head is operated by inserting the index finger into the neck or head cavity. Sometimes called standard glove type hand puppets, they usually have tublar arms which are operated with the thumb and other fingers. Some glove type puppets such as U.S. Pat. Nos. 961,812 and 2,931,137 also provide means for operating the jaw of the puppet with the same hand, but although these glove puppets can nod effectively, they have no means for turning the head independently of the body of the puppet with the same hand.

Another type of puppet utilizers a rod or stick affixed to the neck of the puppet to turn or rotate the head. These so called marots, such as the one shown in U.S. Pat. No. 3,471,966, require the use of two hands if both the head and the arms of the puppet are to be moved simultaneously. Puppets requiring two handed operation are a problem for the solo performer when two puppets are required to interact on stage at the same time.

The most complex type of hand operable puppet is the ventriloquist figure. So called vent figures usually have a very rigid appearance in performance due to a fixed upper head relative to the shoulders of the figure. Although the upper head can be turned or rotated it can not be tilted relative to the shoulder plane when these ventriloquist dummies are made to appear to talk. U.S. Pat. No. 2,114,851 shows a ventriloquist's doll in which the jaw is pivoted downward while the upper head maintains a perpendicular position relative to the turning axis of the neck. The upperr head can not be simultaneously filted up on the jaw is lowered to give an enhanced motion to the mouth. Fully animated head motion requires the tilting of the head side to side, and the back and forth tilting of the head in addition to the motion of the jaw. This natural mouth and head movement is best embodied in the simple sock type mouth puppet which has the widest variety of animation of the upper head and jaw. Such wide range of head and mouth motions are not possible with most ventriloquist figures.

In performance there is a need for more than replication of the motions of the human head in talking. There needs to be exaggeration of these motions to add comedy and allow the audience which may be at a distance to see the motion clearly. Humanly impossible motions such as the complete revolving of the head and elongation of the neck add humor. These actions are not presently possible with most single hand glove puppet inventions. Note, for example, that U.S. Pat. No. 2,633,670, uses a rockable plate within the head structure but the device does not allow the head to rotate independently of the puppet body. Puppets that do not have a means for turning the head relative to the plane of the body or shoulders also may appear rigid in performance, since they appear to be always looking straight ahead. There is a need for combined neck, head, and enhanced mouth movement to add a natural lifelike appearance to the puppet.

Other trick movements such as neck elongation, and head spinning also contribute to a performance. Although U.S. Pat. No. 3,032,921 utilizes a hollow neck tube which slides in a cavity in the upper part of the body to combine jaw action with elongation of the neck, it is an externally operated bellows toy that has no means for internal accommodation of an operator's hand and has a very limited range of action. While this invention does some of the tasks desired, it does not teach the concept in a form that is adaptable to the needs of theatrical performance. It also lacks the tilting head capability of most marots that is useful in performance and it has the shoulder to head rigidity that is undesirable.

Another puppet improvement, U.S. Pat. No. 2,801,495, teaches a hand puppet which utilizes a cable and a manual pull ring to actuate the lower jaw with a resilient closure device to keep the mouth (jaw) closed when there is no tension on the ring. The hand and finger gripping devicce is connected to the head by pivots but similar to the previously mentioned U.S. Pat. Nos. 2,114,851 and 2,771,708 the lower jaw merely drops in a downward direction. It lacks the necessary animation for large audiences. Note that the upper head of the puppet in U.S. Pat. No. 2,801,495 also maintains a rigid perpendicular position relative to the neck. The hollow costume is connected to the neck and prevents the comic spinning of the head. This device also does not teach the elongation of the neck in relation to the body/costume. It should be noted also that U.S. Pat. No. 2,114,851, like most vent figures, does not provide a means for actuating the upper limbs of the figure with the same hand.

Existing U.S. Patents show that there are serious deficiencies that the experienced performer would like to have solved. Head spinning is seldom possible when the neck is affixed to the puppet body and if only the jaw is tilted downward, the mouth opens in a way that is not sufficiently animated.

Another need is for a simple puppet or toy that can have exchangeable heads. There are many cases where to fit changes in expression, age, occupation, would help to develop a character and allow for accessory sales. With present puppet designs this usually means that entirely new puppet must be made, requiring addition manufacture expense. Exchangeable heads are also needed so that a given head can fit onto different sized glove bodies, sized for different hands.

DESCRIPTION OF THE INVENTION

The present invention overcomes many of the limitations of conventional glove type hand puppets.

This invention utilizes a mouthplate located above the jaw and flexibly hinged to the back of the head so as to allow the upper portion of the head to be tilted upward by means of a rod as the jaw portion is simultaneously lowered.

The invention, due to the hinged upper head and jaw provides an enhanced mouth motion.

The invention provides the ability to tilt the head in various directions without changing the angle of the puppet body.

The invention allows a theatrical flip back of the upper head.

The invention further allows head spinning and neck elongation effects.

Above all, this invention allows for single hand operation of the arms, jaw, and head motions in a hand puppet which enables a solo practitioner to have two puppets actively interacting on stage at the same time.

The invention combines functional elements of the sock, the marot, and the standard glove type hand puppets. Whereas a marot has the head affixed directly to the stick, this invention has the lower jaw affixed to a cylindrical tube and the motion inducing stick is not attached to the head of the puppet, nor is the cylindrical tube attached to the body costume of the puppet. This configuration allows for rapid exchanging of the head. The body or body fabirc may be attached to the finger holding bail which is turn is affixed to the center stick or rod. This stick is not attached to the head, so replacement of the head is quite simple. A new center stick can be provided with each new costume, or the bail supplied with a snap or other easy means of removable attachment to the body, so that the stick can be easily attached or removed from the costume.

The body or glove of most hand puppets is a hollow costumed body that has arm elements that are hollow tubes that each accommodate a finger of the operator's hand. Standard glove type hand puppets use the thumb and another finger to animate the arms while the index finger is used to hold and move the head. In some cases, other fingers may be used to push a movable jaw downward against a spring force when speech motions are desired in the puppet, but since the body is attached to the head in most of these inventions the head can not be made to rotate or turn independently of the body or body fabric of the puppet. In this invention, the body or costume is attached to the bail on the central stick. The attachment has the advantage of allowing head and arm motions without disorienting the body or loosing the stick.

An annular finger grip is formed around the base of the neck tube of the puppet. This neck tube and finger grip are substantially narrower than the body opening for the neck to allow both free motion and easy exchange of the heads. The changing of the head can be quickly effected by simply lifting the head off the stick since there is no attachment of the annular neck tube, to the body or the stick that lifts the top of the head.

The action of the puppet head is effected by a stick that is loosely fitted within the cylinder or annulus of the neck tube. This stick, which may be tapered, presses upward onto a mouthplate. The mouthplate can be any surface within the top part of the head, but a flat surface that is located where the roof of the mouth is located in a human is most effective. The jaw of the puppet is attached to the cylindrical tube, and is hinged to the rear part of the upper head which contains the top of the mouth, the nose, eyes, ears, and hair. The hinge usually extends from one side of the back of the head to the other and allows the head to move in an amount dependent on the action of the stick. As the stick is pushed upward, the top of the head tilts backward. At the extreme, a sharp push by the stick can flip the head as far back as the hinge will allow, opening the mouth to an unnatural and comic degree. The weight of the top of the head normally causes the head to drop back to a closed position but when needed a slight flip of the wrist can also close the mouth after extreme opening.

It is also desirable in a few cases to encourage the return of the mouth to a closed position by a spring or elastomeric closing means but generally gravity is simpler and easier. The use of the weight of the head to close the mouth also makes slight motions such as lip trembling or mouth clacking easier.

It is noted that there is an upward motion of the head in addition the downward motion of the jaw. When the cylindrical neck tube is pulled downward, the central stick simultaneously raises the upper head. This bidirectionality and the leverage action, made possible by the location of the stick in relation to the hinge, enhances or can greatly exaggerate the mouth opening and contribute to the animation potential of the puppet when in performance.

A finger support bail is added to the simple dowel shaped central stick to make the device easier to handle. This bail is a wire, wood, or plastic support extending at an angle of about 90 degrees from the lengthwise axis of the stick and is usually shaped to comfortably fit between the fingers. A sketch of the bail and the way the fingers handle the bail and the cylindrical tube is shown in the drawings.

This configuration of a finger bail which is attached to a stick that is slidably received in a cylindrical tube that is not attached to the body of the puppet allows a number of special effects that are not now easily possible in other devices. As mentioned above, the head can be flipped to totally open the mouth in a vastly exaggerated manner. Since the body is not attached to the head, the head can easily be made to spin by simply rotating the cylindrical tube around the center stick. In addition, neck elongation is possible. A querulous or threatening attitude may be expressed by the extension of the neck. Again since the neck is not attached to the body the neck extension is easy. The bail and stick can be attached by a snap or other means at the rear of the body or body fabric and not impede either head spinning or neck elongation capability.

The lack of attachment between the head and the body also allows for head tilting actions that are impossible with many other designs. Since the head is free to tilt in every direction and can also partly swivel, the motions of the head and neck in relation to the body may either be lifelike, enhanced or exaggerated. This makes convincing puppet manipulation much easier.

BRIEF DESCRIPTION OF THE DRAWINGS

FIG. 1 is a side cross sectional view of the puppet illustrating one interior construction of the device.

FIG. 2 is an overall view of the puppet showing the device beneath the body fabric and illustrating one means of holding the device.

FIG. 3 shows a convenient stand for holding, storing, or displaying the device.

THE PREFERRED EMBODIMENT

In the most preferred embodiment, as shown in FIG. 1, the upper head 10 can be solid or hollow. A hollow head was selected since it is light and easy to use. While this head is made from paper maché, any of a variety of materials can be used. The top or upper head unit has a mouthplate 1 that is at the bottom of the part and which has a hinge 2 at the rear. This hinge located at the rear of the jaw 3 is made in this embodiment of leather but can be oriented plastic (a living hinge), rubber, a conventional pin hinge or a separable hinge. A hollow neck tube 4 is integrated in the construction of the jaw 3. The central rod or stick 9 passes through the neck tube and jaw assembly. The stick is not attached to the tube or jaw in any way. The neck tube moves downward relative to the stick. Since the top of the stick rests on the mouthplate, any upward force of the stick relative to the hollow neck tube forces the top of the head up and back. As the jaw 3 which is affixed to the hollow neck-tube is lowered, the top of the head rises. This lever action actually allows the opening of the mouth to be grossly exaggerated with very little displacement of the area near the hinge at the back of the head of the puppet. In this preferred embodiment, the ratio of the contact point of the stick to the hinge to the total length of the top of the mouthplate which extends from the lips of the puppet to the hinge is 1:4.5. This gives a properly theatrical effect in the motions of the puppet. The ratio of total mouthplate length to the stick to hinge length can be varied as needed to provide different mouth actuation appearances.

The annular grip knob shown as 5 is not essential since the manipulation can be done on a straight tube. It is a convenience that makes manipulation of the device easier and prevents the neck tube from slipping between the fingers. The index and median fingers (the first and second fingers from the thumb) are used to manipulate the head, the oracular finger (little finger) and the thumb are used for the manipulation of the arms of the puppet. The remaining finger may be used at times to push the neck upward or to aid in turning the neck tube.

In addition to the grip, the action is dependent on the weight distribution relative to the location that the stick contacts the mouthplate. With ideal weight distribution, minimum effor is needed to make the mouth open or close. Moving the balance point toward the lips of the puppet encourages the mouth to slowly open and close. Moving it toward the hinge encourages the mouth to quickly open or close. While the ideal is to have the stick toward the hinge side of the mouthplate this may be changed for special effects. The effect of the lower jaw as a counterweight to the upper head must also be taken into consideration. The ideal puppet head will behave as in the preferred embodiment and close its mouth by means of gravity but not require much force to open the mouth. With the proper weight distribution and stick placement, the mouthplate will rest in a horizontal position as in FIG. 1 until the grip is lowered in relation to the stick whereupon the mouth will open.

The finger bail 8 provides an important function. It allows the device to be supported without the use of the thumb, and it acts as a stop to prevent overopening of the mouth to a completely open position. The position of the bail regulates the degree to which the mouth is opened in normal use but does not prevent a fast upward thrust of the stick from throwing the mouth to the completely open position. The best position for the bail can be determined experimentally for each head design.

The median and the index fingers may be used to operate the device. The control rod 9 and the bail 8 rests betweena these two fingers. When the grip or the tube is pulled downward, the top of the head is pushed up as the jaw simultaneously drops. This gives an appearance of mouth movement that is natural and animated. The finger brace or bail also prevents the stick from slipping out of the operators hand when the fingers are not gripping the tube as with the head spinning motion. Lifting the tube makes the neck appear to elongate as it is pushed upward within the body of the puppet. This arrangement of parts allows for the easy removal or exchange of the head of the puppet.

The bail 8 is formed with a hole 7 to accommodate a snap or other means of attachment to the body of the puppet 11.

The lower extension of the central rod or stick 12 will easily fit into a stand or holder such as the one shown in FIG. 3. to display the puppet. A hollow tube 15 is affixed to a base 16 and sized to accommodate either ther central stick or the hollow neck tube. When this control rod holder is used, often there will also be a desire to display or store the body costume, in which case, the body costume can easily be snapped or attached to the bail in a variety of ways to hold up the costume of the puppet.

I claim:

1. A hand puppet device consisting of:

an exchangeable head having an upper portion containing a mouthplate, a hinge movably attaching said upper portion to a jaw section, said jaw section affixed to a cylindrical tube, said cylindrical tube slidably and rotatably receiving a rod, said rod being freely removable from said tube, and an accommodating means affixed to said rod providing a means of supporting said device on the hand of an operator, whereby manual movement of said tube relative to said rod causes said upper portion of said head with said mouthplate to move relative to said jaw section to simulate mouth movement.

2. The device as defined in claim 1 wherein said cylindrical tube has a shaped projection on the outer surface to aid in gripping and manipulating said tube.

3. The device as defined in claim 1 wherein said hinge includes an axis, and a protrusion located about said hinge axis for limiting the relative movement of said upper portion with respect to said jaw section.

4. The device as defined in claim 1 wherein said hinge includes means for removably attaching said upper portion with said jaw section.

5. The device as defined in claim 1 wherein said rod has a second accommodating means for inserting said rod into a stand.

6. A theatrical puppet device consisting of;

a hollow costume, an exchangeable head having a mouthplate hinged to a lower jaw, a hollow neck tube connected to said lower jaw, said hollow neck tube having a gripping means for manipulation of said hollow neck tube, said hollow neck tube slidably receiving a rod which is greater in length than said hollow neck tube, an accommodating brace affixed to said rod and acting as a stop to prevent overlowering of said hollow neck tube, said brace providing a means of supporting the device so that head and mouth motions may be actuated by moving said rod in relation to said hollow neck tube and its attached parts.

7. The device as defined in claim 6 wherein said brace and said hollow costume have a means of attachment to each other to prevent misplacement of said rod.

8. The device as defined in claim 6 wherein means is employed to urge said jaw and said mouthplate to a close position.

9. The device as defined in claim 6 wherein said hollow costume has hollow arms for accommodating an operator's fingers allowing manipulation thereof.

10. The device as defined in claim 6 wherein said rod has a projection to accommodate insertion of said rod into a stand.

11. A method to effect mouth motions, in addition to head turning and spinning motions, in a puppet comprising the steps of:

(a) maintaining a rod in a verticle position, (b) gripping a hollow tube, attached to, and communicating through, (a) jaw of said puppet, (c) sliding said tube downward along the axis of said rod which is slidably recieved in, and longer than, said tube, (d) contacting the tip of said rod to (a) surface of a horizontal plate located in (an) upper portion of the head, said head attached by hinge means to said jaw, (e) pressing said tip of said rod against said plate with sufficient force to pivot one side of said plate upward relative to the contact point of said rod with said plate, (f) sliding said tube upward along said axis of said rod thereby allowing the pivotal return of said upper head portion to said jaw, thereby effecting said mouth motion, (g) slowly turning said tube on the axis of said rod, thereby effecting the turning motion of the head of said puppet, (h) releasing grip on said tube and (i) gripping said rod, (j) making a circular motion on a horizontal plane with said tip of said rod, thereby creating a centrifugal force causing said spinning head motion on the axis of said rod.

12. The method as defined in claim 11 whereby sliding the neck tube upward effects an appearance of elongation of the neck of said puppet.

13. The method as defined in claim 11 whereby the head is exchanged with another head by lifting off said head and placing another head on said rod.

14. The method as defined in 11 whereby said rod is supported by means of a projection which is attached to said rod and fits between the fingers of the operator.

15. The method as defined in 11 whereby said hollow tube is manipulated by means of a finger accomodating grip on the outer surface of said hollow tube.

* * * * *